United States Patent [19]

Young

[11] 3,967,647

[45] July 6, 1976

[54] SUBSEA CONTROL VALVE APPARATUS

[75] Inventor: David E. Young, Friendswood, Tex.

[73] Assignee: Schlumberger Technology Corporation, New York, N.Y.

[22] Filed: Apr. 22, 1974

[21] Appl. No.: 462,829

[52] U.S. Cl. ..... 137/614.11; 166/224 A; 166/.5; 251/58

[51] Int. Cl.[2] ..... E21B 43/12; E21B 33/00

[58] Field of Search ..... 137/614.11, 613, 494, 137/458, 614.2, 629; 251/297, 58, 62, 95, 31, 57, 315, 63.6; 166/224 A, 224, 72, 150, 152, 25, .5; DIG. 2

[56] References Cited

UNITED STATES PATENTS

| | | | |
|---|---|---|---|
| 1,233,856 | 7/1917 | Elder | 251/58 X |
| 2,587,539 | 2/1952 | Seaman | 137/613 X |
| 3,233,860 | 2/1966 | Dollison et al. | 251/58 |
| 3,494,417 | 2/1970 | Fredd | 166/224 A X |
| 3,543,793 | 12/1970 | Dollison | 166/224 X |
| 3,675,720 | 7/1972 | Sizer | 166/314 |
| 3,744,564 | 7/1973 | Mott | 166/224 A |
| 3,762,471 | 10/1973 | Mott | 166/224 A |
| 3,763,933 | 10/1973 | Mott | 166/224 A |
| 3,786,865 | 1/1974 | Tausch | 251/58 X |
| 3,799,258 | 3/1974 | Tausch | 166/224 A X |

*Primary Examiner*—Martin P. Schwadron
*Assistant Examiner*—Robert J. Miller
*Attorney, Agent, or Firm*—David L. Moseley; William R. Sherman; Stewart F. Moore

[57] ABSTRACT

A control valve apparatus adapted to be positioned within a subsea blowout preventer stack for controlling the flow of fluid from an offshore well includes a control unit releasably latched to a valve body having tandem, normally closed valve assemblies, the upper valve assembly including a flapper valve element and the lower valve assembly including a ball valve element. The control unit has hydraulically operable mechanisms adapted to open the valve elements in response to pressurization of control lines extending upwardly to the surface, and to assist in closure of the ball valve element to effect cutting of wireline or cable extending into the well in case of emergency.

21 Claims, 8 Drawing Figures

SUBSEA CONTROL VALVE APPARATUS

This invention relates to a new and improved control valve apparatus that is adapted to be positioned within a subsea blowout preventer stack for controlling the flow of fluids from an offshore well during a production test or the like.

The data that can be obtained from a drill stem or a production testing of an oil or gas well is of great value in identifying commercial pay zones. The data is rather easily obtained where the wellhead and the production installation are in place, which is the case, for example, for land based wells. Unfortunately, however, in the case of offshore exploratory drilling, completion costs are so substantial that extensive tests are needed not only to identify commercial zones but also to provide a basis for a determination of the type of surface equipment that will be necessary to produce the well.

One method for conducting such tests is to equip the well with a subsea wellhead and allow the well to flow into mobile production testing units employed at the rig. Once the required information has been obtained, the well can be closed temporarily through use of a downhold plug in conjunction with a cap fitted on top of the casing string. The well can be left shut-in while decisions on completion are made, based upon the test results. To complete the well, a workover platform is placed on the well to allow reentry. The foregoing procedure is slow, however, and ill adapted in case the well has to be abandoned in case of emergency. Moreover, it is necessary to remove the subsea blowout preventer "stack" in order to install the wellhead, which reduces the control of the well in a highly undesirable manner.

Over the past few years, techniques and equipment have been developed for testing an offshore well without removing the blowout preventer stack, and which allow such testing to be conducted from floating or semi-submersible vessels and supports. For example, the apparatus shown in U.S. Pat. No. Re. 27,464, is suitable for this purpose, and in addition provides a subsea master valve which can be controlled from the surface during testing operations. The device is fail-safe, in the sense that it normally is closed in the absence of control pressure, and can be utilized to temporarily plug the well after production tests. The well can be reopened for further tests, and for completion operations such as perforating and cementing at the end of production or drill stem tests.

Although the aforementioned equipment has been widely used, it suffers from a number of significant shortcomings. The valve system employs tandem ball valve systems with hydraulic actuation via various flow passages in the tool body that is seated within the blowout preventer stack. The valve construction is inherently complex both from a mechanical and a hydraulic standpoint, and thus is subject to various malfunctions such as sticking and leakage of control fluid. In addition, the valve body has a lengthy construction due to the complex valve mechanisms housed therein, and to their method of actuation, to the extent that it is not possible for the uppermost blind rams of the typical blowout preventer stack to be closed thereabove in case of emergency disconnection of the control pod that leads from the top of the valve body up to the floor of the drilling vessel. Therefore complete control of the well is not possible, in case the ball valves for some reason fail to close and leave the pipe string leading to the formation open. Moreover, the method of disconnection used for this device leaves the fluid control line passages and other mechanisms exposed to contamination by sea water and/or drilling mud.

In copending application Ser. No. 462,824, filed concurrently herewith and assigned to the assignee of this invention, a subsea valve apparatus is disclosed and claimed which overcomes the aforementioned disadvantages by providing a unique structural combination wherein a valve section of relatively short length has its upper end releasably connected to a remotely operable valve control unit. The control unit includes the various hydraulically operable means for actuating the valve as well as connecting and disconnecting the unit to and from the valve section, so that when the control unit is retrieved to the vessel the blink rams of the preventer can be closed above the valve section to ensure complete control of the well, and there are no exposed hydraulic connections or the like remaining at the vicinity of the sea floor which are subject to contamination by sea water or drilling muds. Moreover, the new and improved apparatus covered by the aforementioned application incorporates one or more flapper valves for shutting off the flow of well fluids, which is a much more simple and reliable system than is known in the prior art.

Yet another shortcoming of prior art devices, to which the present invention is directed, is that of being unable to provide a foolproof system for cutting wireline or cable extending through the valve section and into the well in the event that disconnection of the control unit is to be effected in an emergency situation where there is insufficient time to retrieve the wireline tools from the well. Although such prior apparatus and systems incorporate ball valves and the like, which are considered to be capable of cutting wireline or cable during closure, the maximum forces available are due only to normal and typical valve closing action under the influence of springs. Thus it is possible that the line will not be cut but rather will jam the ball valve in its open position and thus leave the well open to production in a highly undesirable manner.

It is one object of the present invention to provide a new and improved subsea control valve apparatus including means for positively assisting the closure of a valve which is capable of cutting wireline or cable where necessary in case of emergency.

Another object of the present invention is to provide a new and improved subsea control valve apparatus that is simple and reliable in operation, and which includes a combination of valve assemblies that provide for fail-safe closure of an offshore well under all circumstances including emergencies or other adverse conditions.

These and other objects are attained in accordance with the concepts of the present invention through the provision of a valve section and a control unit that are releasably connected together and adapted to be landed within a subsea well installation for controlling the flow of fluids from the well. The valve section includes upper and lower valve assemblies with the upper assembly preferably incorporating a flapper valve element and the lower assembly preferably comprising a ball valve element. Both valve elements have the capability for closing the production string extending into the well, and the ball valve has the additional capability of cutting wireline or cable extending therethrough under sufficient closing force.

The control unit includes separate hydraulically operated mechanisms for actuating the valve elements from their normally closed to open positions. In the case of the flapper valve element, the mechanism includes an actuator sleeve that is coupled to a piston means in such a manner that when a control line leading to the surface is pressurized, the sleeve is advanced through the seat to push the valve to open position. The ball valve element is mounted on a tubular cage that can move upwardly and downwardly within the valve body, and is rotated between open and closed position by an eccentric that is coupled in fixed relation to the body. Another hydraulically operable mechanism including a piston means is releasably connected to the cage in such a manner that pressurization of the above-mentioned control line also will shift the case within the valve body and thus rotate the ball element from its normally closed position to open position. This piston means also is responsive to pressurized fluid in a second control line for forceably assisting movement of the cage in the opposite direction within the valve body in addition to the normal closing force of a spring action thereon. Such pressure assist ensures that ample torque will be applied to the ball valve element to cause complete closure thereof and consequent cutting of a wireline or cable extending therethrough.

The present invention has other objects and advantages which will become more clearly apparent in connection with the following detailed description of a preferred embodiment, taken in conjunction with the appended drawings in which.

Figure 1:
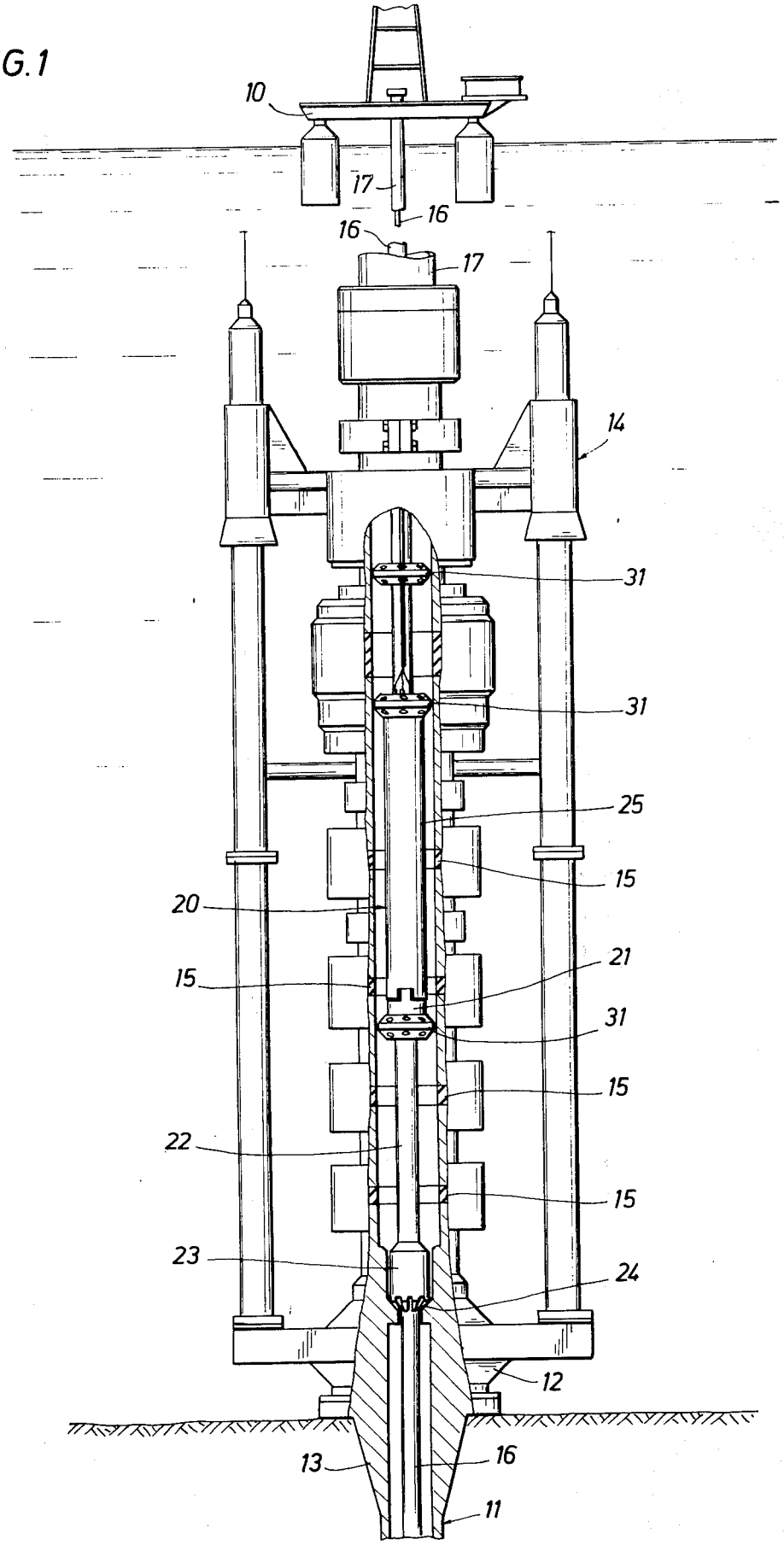
FIG. 1 is a schematic view of an offshore well installation undergoing a production or drill stem test from a floating vessel, utilizing a subsea control valve apparatus constructed in accordance with the principles of the present invention.

Referring initially to FIG. 1, there is shown somewhat schematically a floating or semi-submersible drilling vessel 10 stationed over an offshore well 11. A casing head 12 is fixed to the top of the well casing 13 and is connected to a blowout preventer stack 14 that has a plurality of pairs of laterally movable rams 15 adapted when closed to shut-off the annulus between the casing 10 and a production tubing 16 or other conduit extending into the well. A marine riser 17 is connected in a conventional manner to the top end of the blowout preventer stack and extends upwardly to a point above the water surface where it may be coupled to the vessel by a typical riser tensioning system. Various hydraulic lines and the like extend from onboard control panels down to the blowout preventer stack in order to provide for hydraulic actuation of the various components thereof in a well known manner.

Inside the BOP stack 14 is positioned a control valve apparatus 20 constructed in accordance with the principles of the present invention and connection into the flow conduit 16 leading from the surface downward to the well formation undergoing test. The control valve apparatus 20 includes a valve section 21 connected by a slick joint 22 to a fluted hanger flange 23 which is sized and arranged to rest on a shoulder surface 24 at the lower end of the stack 14. The lower rams of the BOP provide for closure around the slick joint 22, whereas the hanger flange 23 supports the pipe string 16 extending into the well. Releasably connected to the top of the valve section 21 is a hydraulically operated control unit 25 that incorporates mechanisms which function to open one or more valves within the section 21 in response to the application of fluid pressure to control lines extending upwardly alongside the pipe string 21 to the vessel 10, as well as a releasable connector that enables selective connection and disconnection of the unit 25 to and from the valve section 21. A plurality of guide flanges 31 serve to center the assembly 20 within the bore of the BOP stack 14 in a typical manner.

Figure 2A:
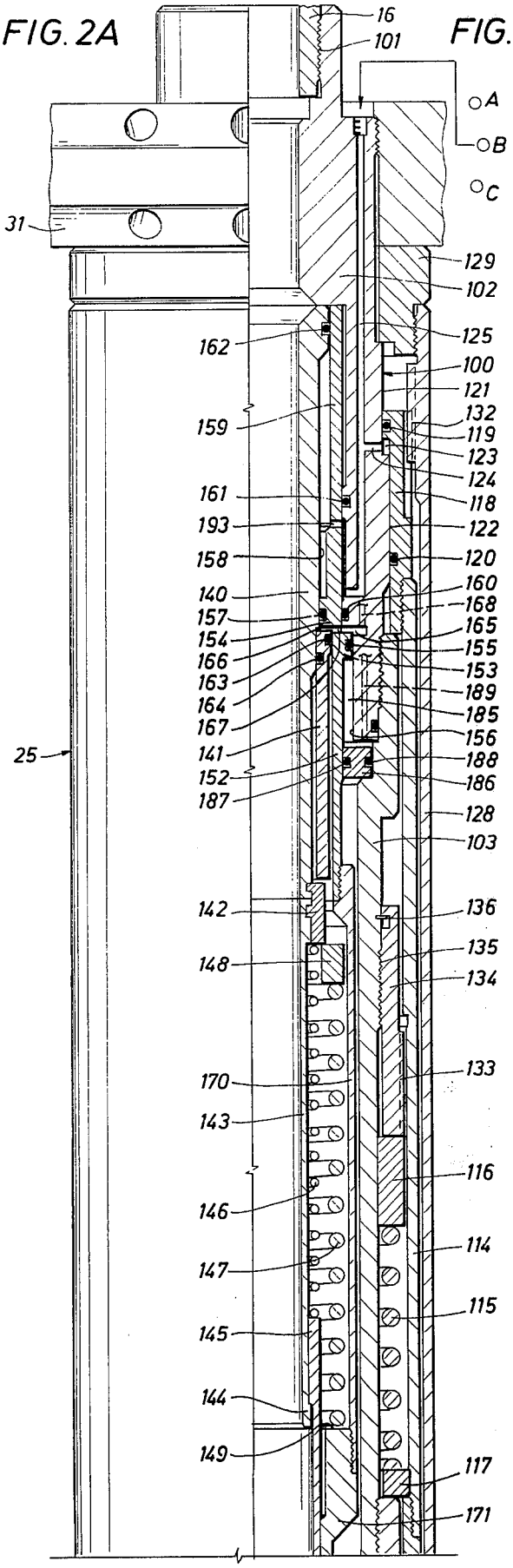
FIGS. 2A-2B are longitudinal sectional views, with portions in side elevation, of the control valve apparatus with the valve section and the control unit releasably connected together.
Figure 2B:
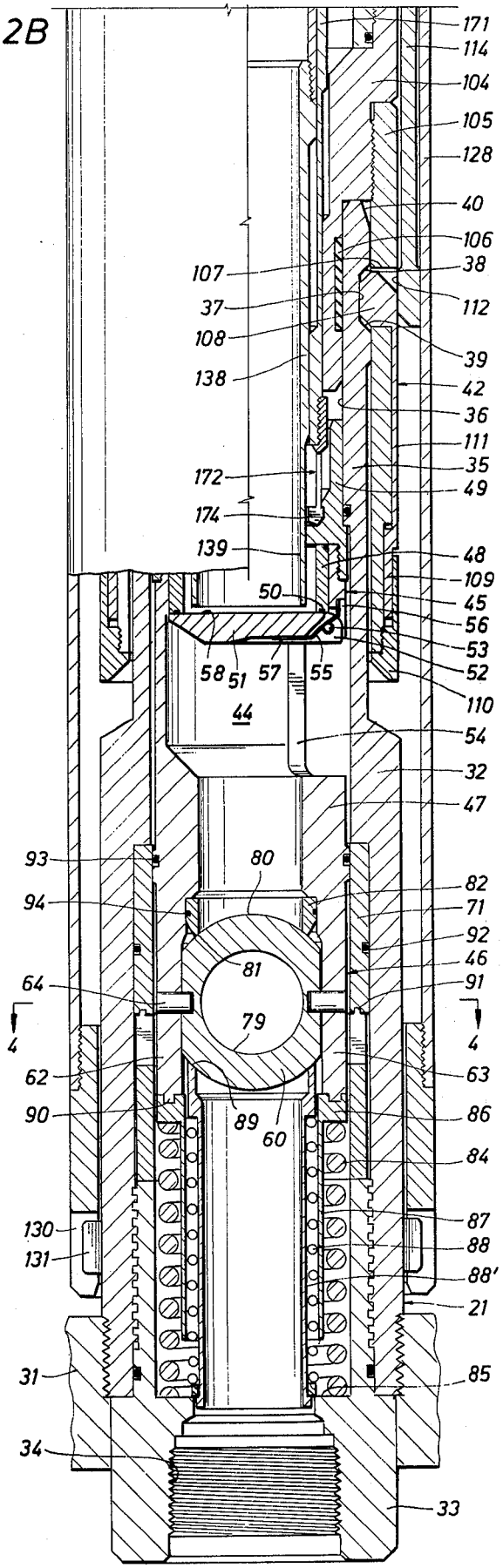

Referring now to FIGS. 2A and 2B for enlarged detail of the construction of the valve section 21 and the control unit 28, a valve body 32, generally tubular in form, includes a coupling 33 at its lower end having threads 34 adapted for connection to the slick joint 22. The upper end of the valve body 32 is constituted by a latch extension 35 having an internal seal bore 36 and an external latch or detent groove 37 extending therearound. The upper and lower walls 38 and 39 of the groove 37 are inclined in opposite directions, and the upper outer surface 40 of the extension 35 also is inclined downwardly and outwardly for cooperation with a plurality of latch dogs 42 as will subsequently be described.

The valve body 32 has a throughbore 44 providing a fluid passage. The passage is adapted to be opened and closed by an upper valve assembly 45 and a lower valve assembly 46 that are carried by a tubular cage 47 which is slidable vertically within limits within the bore 44 of the valve body 32. The upper valve assembly 45 includes a valve seat ring 48 fixed within the cage 47 below a connector head 49 and carrying a downwardly facing seal ring 50. A "flapper" valve element 51 in the form of a disc has an outwardly extending ear 52 that is pivoted by a transversely extending pin 53 to the cage 47 above a window 54 within which the disc is disposed when it swings downwardly to open position. A hinge spring 55 surrounds a portion of the pin 53 and has tangs 56 and 57 respectively engaging the cage 47 and the lower surface of the valve element 51 in such a manner that the spring continuously urges the element to swing upwardly to a closed position where its outer peripheral surface 58 engages the seal ring 50. Additional seals such as O-rings, are provided on the seat ring 48 and the extension 35 to prevent leakage past the valve assembly 45 in the closed position.

Figure 3:
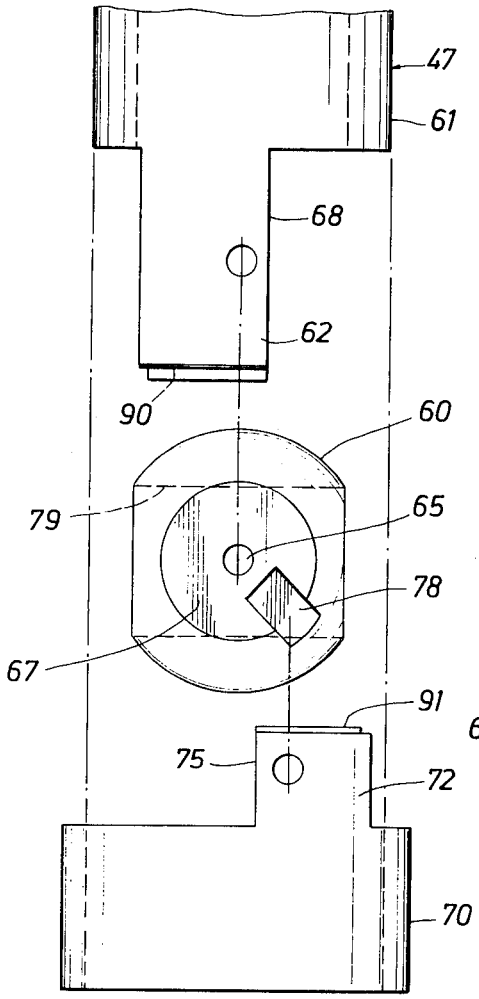
FIG. 3 is an exploded view of the principal parts of the ball valve assembly of FIG. 2B.
Figure 4:
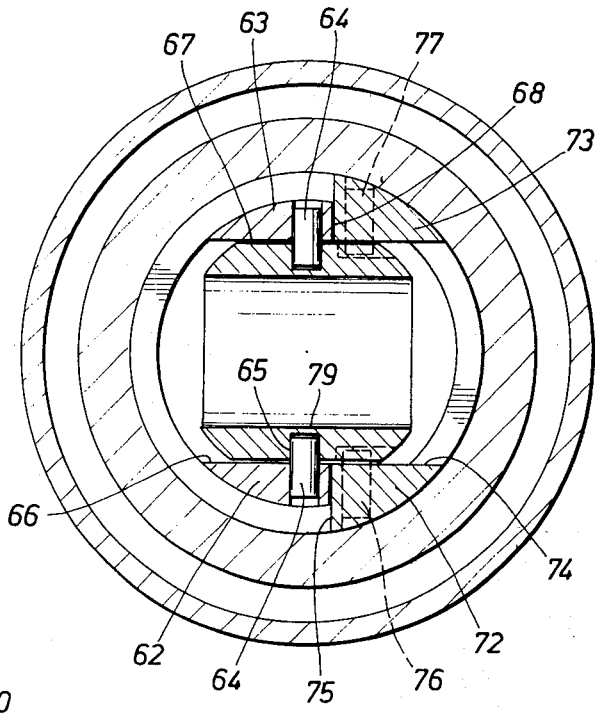
FIG. 4 is a cross-sectional view taken along lines 4—4 of FIG. 2B to further illustrate the ball valve assembly.

The lower valve assembly 46 as shown in some detail in FIG. 2B and more specifically in FIGS. 3 and 4, includes a ball valve element 60 that is rotatably mounted on the lower end portion 61 of the valve cage 47 for movement between open and closed positions with respect to the flow passage 44. The lower end portion 61 is formed with depending legs 62 and 63, each of which is interfitted with a trunnion pin 64 that is received within an aperture 65 on the side of the ball element 60. The inner surface 66 of each leg 62 or 63 is formed parallel to to the flat side walls 67 of the ball at right angles to its axis of rotation, whereas the flat end wall 68 of each leg is laterally offset from the rotation axis. The lower portion 61 is sized and arranged to fit slidably within the bore of a sleeve 70 that is fixed within valve body 32 below a tubular bushing 71 and the upper end of the coupling sub 33. The sleeve 70 has upwardly projecting bosses 72 and 73 formed on its upper end, with each boss having a flat inner wall 74 formed in the same plane as the wall 66 of a respective leg 62 or 63, and a flat outer face 75 against which the outer face 68 of a leg is slidable. Oppositely disposed pins 76 and 77 are fitting within holes in the bosses 72 and 73 and extend into eccentrically disposed grooves 78 formed in peripheral surfaces on the ball 60 when the parts are assembled. The pins 76, 77 and the grooves 78 are arranged such that when the cage 47 is in its upper position within the valve body 32, the throughbore 79 of the ball 60 is at right angles to the flow passage 44 where its upper peripheral surface 80 engages the spherical valve seat surface 81 of a seat ring 82 carried by the cage 47. On the other hand, when the cage 47 is shifted downwardly within the valve body 32, the pins 76 and 77 cause the ball 60 to rotate 90° to a position where the bore 79 of the ball is vertically aligned with the central flow passage 44 of the valve body. A coil spring 84 that reacts between an inwardly extending shoulder 85 on the coupling member 33 and the outwardly extending flange 86 at the top of a tube 87 which engages the lower end of the cage 47 biases the cage upwardly within the valve body 32 so that normally the ball element 60 is rotated to the closed position. In addition, a relatively light spring 88 pushes upwardly on a tubular follower 88' having an upper end surface 89 in engagement with the periphery of the ball 60 to provide for smooth flow of fluids therethrough and to isolate the rotating mechanism from sand or other debris in the fluids. Accurate alignment of various parts is maintained by outstanding annular ribs 90 and 91 that are interfitted within companion grooves as shown to ensure against any binding of the ball during operation. Seal rings 92, 93 and 94 prohibit fluid leakage upwardly past the ball element 60 in the closed position.

The control unit 25 as shown principally in FIGS. 2A and 2B includes a tubular housing member 100 that is connected by threads 101 at its upper end to the pipe string 16 extending upwardly to the drilling vessel 10. The housing member 100 may be constituted by several sections that are threadedly connected together, including a ported upper sub 102, an intermediate sub 103, a lower seal sub 104 and an outer connector sub 105. The seal sub 104 fits within the seal bore 36 of the valve body 32 and carries a packing assembly 106 which provides a fluid tight connection. The connector sub 105 has a plurality of radially directed openings 107 through the wall thereof, which are sized and arranged to receive the enlarged head portions 108 of a like member of the circumferentially spaced latch dogs 42. The lower end portion 109 of each latch dog 42 is retained by a collar 110 screwed onto the lower end of the sub 105, and the mid-sections 111 of each latch dog are laterally flexible to the extent that the head portions 108 can occupy inner positions as shown where they engage the detent groove 37, and outer positions where they are released therefrom. Normally however, the head portions 108 are held inwardly by an annular locking surface 112 on an elongated, tubular latch mandrel 114 which is movable relatively along the housing member 100 between a lower position as shown, and an upper position where the locking surface 112 is disposed above the head portions. A coil spring 115 reacts betwen stop rings 116 and 117 to bias the latch mandrel 114 toward the lower position. A piston head 118 is connected to the upper end of the mandrel 114 and carries seal rings 119 and 120 in sealing and sliding engagement with respective external surfaces 121 and 122 of the housing member 100. Inasmuch as the upper surface 121 is of a lesser diameter than the lower surface 122, an annular chamber 123 is formed with a transverse dimension such that fluid pressure can force the mandrel 114 upwardly along the housing member 100 for release of the latch dogs 42. A control fluid under pressure is communicated to the chamber 123 via a port 124 that communicates with a vertical passage 125 extending to the top surface of the housing member 100 where it is appropriately connected to a control line B extending upwardly to the onboard control panel.

An elongated protector sleeve 128 is fixed to a collar 129 near the upper end of the housing member 100 and extends downwardly to the vicinity of the valve body 32 in order to shield the latch mandrel 114 from being accidentally driven upwardly to the latch releasing position due to engagement with an obstruction as the assembly is being lowered through the riser 17 and into the BOP stack 14. The lower end of the protector sleeve 128 has upwardly extending slots 130 formed therein which engage a plurality of outwardly directed lugs 131 on the valve body 32 to prevent relative rotation. The latch mandrel 114 is corotatively secured to the protector sleeve 128 by interengaged splines and grooves 132 on the piston head 118 and the upper end of the mandrel respectively. Moreover, the latch mandrel 114 is splined at 133 near its midsection to a jack sleeve 134 that is threaded at 135 to the housing member 100. With the elements 128, 114 and 134 thus held against rotation in the BOP stack 14, it is possible to rotate the housing member 100 relative thereto and, after disrupting one or more shear rings 136 or the like at a predetermined torque load, to mechanically feed the latch mandrel 114 upwardly to the released position.

The control unit 25 further includes instrumentalities adapted for actuation of the upper and lower valve assemblies 45 and 46. To control the opening of the upper assembly 45, an elongated actuator sleeve 138 may be shifted downwardly from the position shown in FIG. 2B to a lower position where the end portion 139 thereof projects through the seat ring 48, thereby swinging the flapper element 51 to the open position within the window 54 and retaining it in such position. To actuate the lower valve assembly 46 it is necessary to shift the valve cage 47 downwardly within the valve body 32 to cause pivotal rotation of the ball to open position. Downward movement of the actuator sleeve 138 is accomplished in response to a hydraulically operable piston means constituted by an elongated tube 140 that carries a sleeve piston 141 located above a drive nut 142 that connects the tube to a depending tubular extension 143. The lower end portion of the extension 143 and the upper end portion of the actuator sleeve 138 are provided with opposed shoulders 144 and 145, one above the other, and are slidably arranged to telescope somewhat in lost-motion. A coil spring 146 presses upwardly on the drive nut 142 and downwardly on the upper end face of the actuator sleeve shoulder 144 and thus urges the members in opposite longitudinal directions. A second coil spring 147 is arranged to react between a stop ring 148 that abuts the nut assembly 142, and an inwardly directed shoulder 149 on a tubular member 171 that comprises a part of the ball valve actuator mechanism to be described below. The spring 147 presses the hydraulically operable piston means upwardly within the housing member 100 and tends to position it such that the flapper valve element 51 is automatically closed against the seat ring 48 by the hinge spring 55.

The ball valve actuator assembly that functions to shift the cage 47 downwardly within the valve body 32 includes an elongated piston member 152 having oppositely directed seal flanges 153 and 154, with the flange 153 being located adjacent the upper end of the sleeve piston 141, and the inwardly directed flange 154 being located thereabove. An O-ring seal 155 slidably engages an internal cylinder surface 156 of the housing member 100, and a seal 157 on the flange 154 engages an external surface 158 of the tubular member 140. An upper portion 159 of the member 152 is sealed with respect to the housing member 100 by rings 160 and 161, and with respect to the tubular member 140 by a seal ring 162 at the upper end thereof. In addition, the sleeve piston 141 that constitutes a part of the flapper valve actuator assembly carries seal rings 163 and 164, so that the arrangement provides annular chamber spaces 165 and 166 that are communicated with each other by one or more radially directed ports 167 extending through the wall of the member 152 between the seal flanges 153 and 154. The chamber spaces 165 and 166 are adapted to be supplied with a control fluid under pressure by a vertical port 168 leading to the top of the housing member 100 where it is connected to a control line A extending upwardly to the surface. Pressurization of the control line A will thus tend to force both the sleeve piston 141 and the tubular member 152 downwardly within the housing member 100.

Figure 5:
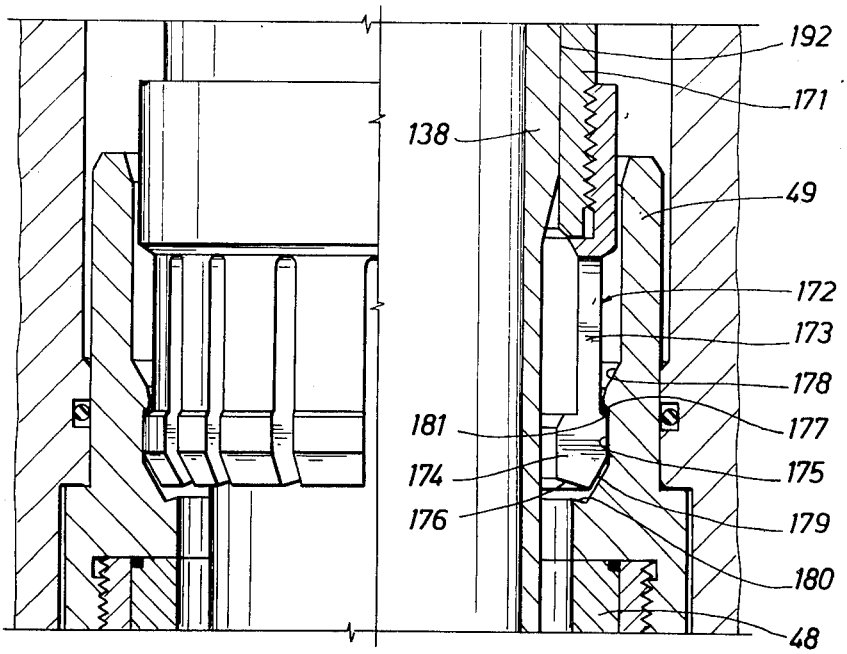
FIG. 5 is an enlarged, fragmentary cross-sectional view of the collet connection between the upper end of the valve assembly cage and a valve actuator sleeve.

The lower end of the member 152 is threadedly connected to an intermediate sleeve 170 which surrounds the extension 143 in laterally spaced relation, and which is, in turn, connected to a drive sleeve 171 having a collet 172 at its lower end. The collet 172 has a plurality of spring fingers 173 with lower head portions 174 shaped and arranged to engage a recess 175 in the connector head 49, with the lower face 176 of each head being inclined upwardly and inwardly as shown in detail in FIG. 5. The lower outer surface 179 of each head 174 is inclined upwardly and outwardly, whereas the upper outer surface 177 of each head is inclined outwardly and downwardly. The recess 175 is formed with companion shaped surfaces, including a downwardly and inwardly inclined surface 178, whereby it will be apparent to those skilled in the art that heads 174 can be forceably engaged with the recess 175 due to the lateral flexibility of the spring fingers 173 and the camming action of the surfaces 179 and 178. Once the heads 174 are engaged with the recess 175, it is possible to transmit longitudinal force therethrough to shift the cage 47 downwardly within the valve body 32 due to the fact that the lower surfaces 176 and 180 will tend to retain the heads within the recess. On the other hand, a predetermined upward force on the latch fingers 174, determined by their resistance to inward flexure, and the angles of the cam surfaces 177 and 181, is required to release the heads 174 from the groove or recess 175 in the connector head 49.

It thus will be appreciated that downward movement of the drive sleeve 171 due to pressurization of the chamber space 165 via the control line A is transmitted by the collet 172 to the valve cage 47 and causes it to move downwardly also. Such downward movement, in turn, causes the ball valve element 60 to rotate to the open position as the ball closure spring 84 is compressed. The same hydraulic pressure within the chamber space 166 forces the sleeve piston 141 and various parts coupled thereto downwardly within the housing member 100, and when the cage 47 reaches the lower limit of its movement within the valve body 32 such parts continue to move downwardly, thus compressing the flapper opening spring 146 as well as the outer return spring 147. The opening spring 146 thus is armed and able to push the actuator sleeve 138 downwardly through the seat 48 and cause the flapper element 51 to swing to open position.

A release of pressure applied to the control line A will enable the outer return spring 147 to reposition the piston assembly 141 and the actuator sleeve 138 in their upper position relative to the tubular member 152, thus withdrawing the lower portion 139 of the sleeve from within the seat ring 48 and enabling automatic closure of the flapper element 51. Moreover, the ball valve closing spring 84 shifts the valve cage 47 upwardly within the valve body 32, repositioning the tubular member 152 and causing the ball valve element 60 to rotate to closed position. To provide for a hydraulic assist to closure of the ball element 60, in case, for example, it is necessary in an emergency to cut wireline or cable extending therethrough and into the well, an annular chamber 185 is formed below the seal flange 153 on the tubular member 152 as shown in FIG. 2A, the lower end of the chamber being defined by a fixed ring 186 on the housing member 100 carrying seals 187 and 188. A third vertical passage 189 connects the chamber 185 with a control line C extending upwardly to the surface, so that pressurization of the chamber forces the tubular member 152 upwardly within the body member 100. Such force is transmitted to the cage 47 by the collet 172, and supplements the upward force of the ball closure spring 84. The combination of forces is ample to cause the ball 60, as an edge formed by the wall of the bore 79 therethrough passes the edge of the valve seat 82, to cut wireline or cable extending therethrough.

In operation, a production of drill stem testing tool string is lowered into the well 11 on the pipe string 16 to test depth less water depth. The subsea control valve apparatus 20 is then installed in the pipe string, and the hyraulic control lines A, B, and C from the control panel and reel onboard the vessel 10 are connected to the upper end of the housing member 100. The apparatus 20 is then lowered through the riser 17 until the assembly is landed in the blowout preventer stack 14 at the sea floor, and the hanger flange 23 abuts against the hanger shoulder 24. The various parts and subassemblies are in the positions shown in FIGS. 2A-2B during lowering, that is to say with the valve cage 47 in the upper position where the ball element 60 is closed and with the actuator sleeve 138 above the valve seat 48 so that the flapper element 51 is closed. After the apparatus 20 is landed, the lower ones of the pipe rams 15 are closed around the slick joint 22 to seal off the annulus between the pipe 16 and the well casing 13.

Figure 6:
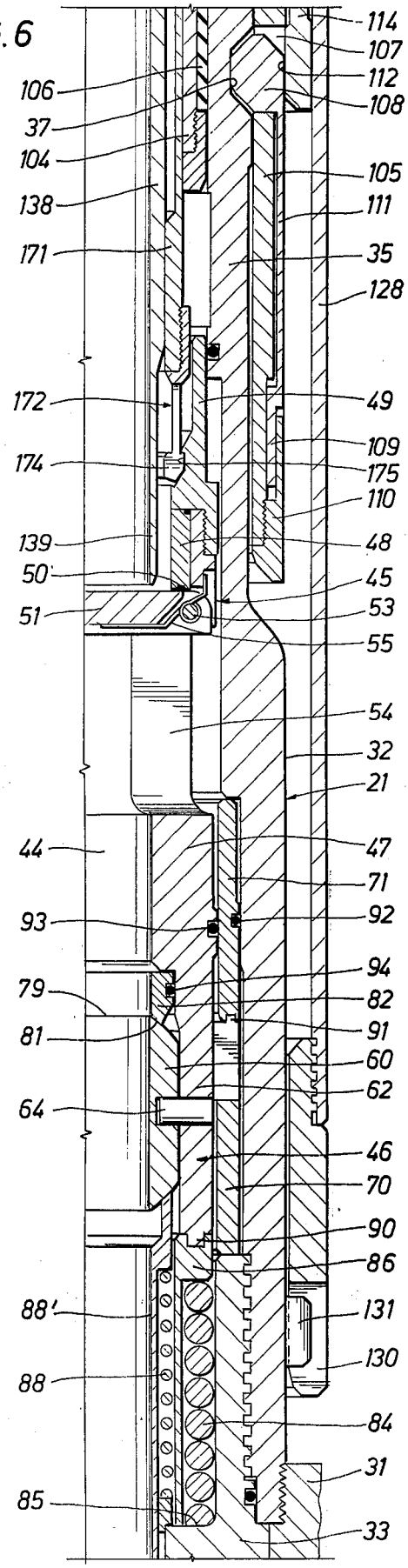
FIGS. 6 and 7 are quarter section views of the apparatus showing, respectively, the opening of the ball valve assembly and the subsequent opening of the flapper valve assembly.
Figure 7:
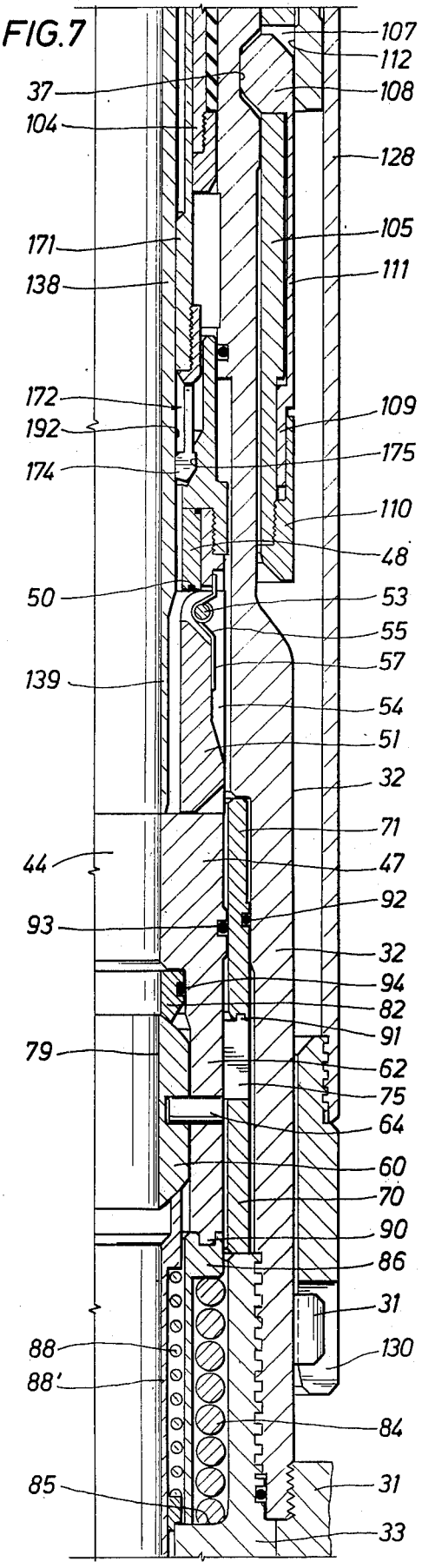

When it is desired to open the valve assemblies 45 and 46 so that the well can produce, the line A is pressurized from the onboard control panel. The corresponding pressure in the chamber spaces 165 and 166 acts downwardly on the resultant area of the outer piston assembly 152, as well as on the inner piston assembly 141, causing the assemblies to shift downwardly within the housing member 100, typically in unison. Such downward movement causes corresponding downward movement of the valve cage 47 within the valve body 32 and rotation of the ball valve element 60 to open position as shown in FIG. 6. When the cage 47 reaches the limit of its downward movement defined by full compression of the coil spring 84, the inner piston assembly 141 will continue to move downwardly as the coil spring 146 that reacts between the piston assembly and the actuator sleeve 138 is compressed and loaded, as is the return spring 147. Then pressures can be equalized, if necessary, across the closed flapper valve element 51 to enable the actuator sleeve 138 to be advanced by the coil spring 147 through the valve seat 48, pushing the element 51 to full open position within the window 54 as shown in FIG. 7. The outer locking surface 192 on the actuator sleeve 138 is positioned behind the heads 174 of the collet connector 172 to positively lock the heads in engagement with the detent groove 175. As long as pressure is maintained on the line A, the upper and lower valve assemblies 45 and 46 will remain open to the flow of production fluids from the well via the pipe string 16.

To close the valve assemblies 45 and 46, pressure in the line A is bled off. The ball valve closure spring 84 then shifts the cage 47 upwardly within the valve body 32, causing the ball 60 to be rotated to closed position as shown in FIG. 2B. Moreover, the flapper valve closure spring 147 elevates the inner piston assembly 141 and the actuator sleeve 138 to their initial upper position where the lower end portion 139 of the actuator sleeve is withdrawn from through the seat ring 48, enabling the hinge spring 55 to automatically close the flapper element 51. Accordingly the production pipe 16 to shut off against any upward flow of fluids therethrough.

In the even that a wireline tool is suspended in the well for perforating or the like, and an emergency condition dictates that the well be shut in before there is time to retrieve the wireline tool to the vessel 10, the lower valve assembly 46 can be used to cut the wireline as follows. The line C is pressurized from the surface to a value in excess of the pressure being applied to the line A. The pressure differential acts on the lower exposed face of the seal flange 153 to exert upward force on the drive sleeve 171 which is transmitted to the cage 47 by the collet 172. The combination of the hydraulic force and the force of the return spring 84 is applied in an upward direction to the cage 47 and is simply adequate to cause the ball element 60 to cut wireline or cable. If desired, a pressure regulator valve (not shown) may be connected at the surface in the line A to enable a maximum differential pressure to be developed across the seal flange 153. The locking surface 192 on the flapper actuator sleeve 138 remains inside the collet heads 175 to prevent release of the collet 172 during line cutting operations, thereby enabling greater torque to be applied to the ball 60 than would otherwise be available during an unlocked, mechanical release thereof. The leading edge of the ball bore 79 acts in conjunction with the sharp edge of the seat ring 91 to completely shear the line or cable in two. Once cut, of course the wireline remaining above the ball element 60 can be pulled upwardly through the flapper element 51 so as not to impede its closure.

To release the control unit 25 from the valve assembly 21, the line B is pressurized to apply upward force to the piston head 118 at the upper end of the latch mandrel 114. The resulting force overcomes the bias of the coil spring 115 and causes the mandrel 114 to shift upwardly to a position where the locking surface 112 is above the latch heads 108. Then the control unit 25 is pulled upwardly by the pipe string 16, causing the heads 108 to be cammed outwardly from the detent groove 37 by the inclined surface 39. In addition, the collet heads 174 are forceably released from the detent groove 175 in the connector head 175. The entire control unit 25 then can be retrieved to the surface leaving the valve section 21 within the blowout preventer stack 14 with both of the valve assemblies 45 and 46 in closed condition. The valve body 32 is of such short length that at least the upper blind pair of the rams 15 of the preventer can be closed against one another to ensure complete control of the well.

To reconnect the control unit 20 with the valve body 32, a procedure similar to the disconnection procedure described above is used. The control unit 25 is lowered through the riser 17 with the control line B under pressure to hold the latch mandrel 114 in the upper position. When the latch heads 108 encounter the outer inclined surface 40 of the valve body 32, they are cammed outwardly thereby and then snap into the detent groove 37. The housing member 100 can be rotated somewhat to ensure that the slots 130 on the protector sleeve 128 are properly engaged with the lugs 131 on the valve body 32, and then the pressure in the line B is bled off. The latch mandrel 114 is shifted downwardly by the coil spring 115, whereby the latch heads 108 are locked within the detent groove 37 by the locking surface 112. As the above connection is made, the collet 172 also couples with the detent groove 175 of the connector head 49 due to the camming action of the surfaces 178 and 179.

Should it become necessary to effect a mechanical release of the latch dogs 42 in case, for example, there is a lack of hydraulic power or leakage of control fluid, the pipe 16 can be rotated at the surface to cause corresponding rotation of the housing member 100. When the shear ring 136 is disrupted at a predetermined torque value, continued rotation causes the jack sleeve 134 to lift the latch mandrel 114 upwardly to the released position.

It now will be recognized that a new and improved subsea control valve has been disclosed herein having significant features and improvements over prior art devices. Dual fail safe values are provided which are reliable in operation, and the valve actuators all are contained in a retrievable control unit. There is no communication of hydraulic fluid directly to the valves and thus no danger of contamination of the fluid by drilling mud or sea water. Moreover, if it is necessary to disconnect the control unit for an extended period of time, the valve actuators do not remain on the ocean floor to become corroded by the subsea environment. A unique combination of valves is provided which enables wireline or cable to be cut in case of emergency, with a hydraulic assist for greater reliability. The valve section is of relatively short length so that the blind rams of a blowout preventer stack can be closed thereabove upon disconnection of the control unit. Reconnection of the control unit takes place deep in the preventer stack and not in the area of the riser ball joint, greatly reducing the possibilities of misalignment.

It will be recognized that although the present invention has been descirbed in connection with a production or a drill stem test of an offshore well, the equipment has wide utility in many kinds of general completion and workover operations of offshore wells. Also, the control valve may be left in the subsea installation as a shut-off valve for extended lengths of time. Since certain changes or modifications may be made in the disclosed embodiment without departing from the inventive concepts involved, it is the aim of the appended claims to cover all such changes or modifications falling within the true spirit and scope of the present invention.

I claim:

1. Apparatus adapted to be positioned in a subsea blowout preventer stack or the like for controlling the flow of fluid from an offshore well, comprising: a valve body having a flow passage; upper and lower valve assemblies in said body for opening and closing said passage; a valve control unit adapted for connection to a pipe string and having a flow passage arranged to place said pipe string in fluid communication with said first-mentioned flow passage; remotely and selectively operable means for releasably connecting said control unit to said valve body; first hydraulically operable means within said control unit for opening said upper valve assembly in response to pressurization of a control line; and second hydraulically operable means within said control unit for opening said lower valve assembly in response to pressurization of said control line, both of said valve assemblies being automatically returned to closed position in the absence of pressurization of said control line.

2. The apparatus of claim 1 wherein said upper valve assembly includes a flapper element adapted for pivotal rotation between an open position to the side of said first-mentioned flow passage and a closed position transverse to said first-mentioned flow passage, said element in said closed position preventing upward flow of fluids from the well.

3. The apparatus of claim 2 wherein said first hydraulically operable means includes an actuator sleeve movable downwardly in response to pressurization of said control line to cause pivotal rotation of said flapper element from said closed position to said open position.

4. The apparatus of claim 3 further including spring means for shifting said actuator sleeve upwardly to enable automatic closure of said flapper element in the absence of pressurization of said control line.

5. The apparatus of claim 1 wherein said lower valve assembly includes a ball element adapted for rotation between position opening and closing said first-mentioned flow passage; means movable upwardly and downwardly within said valve body for mounting said ball element; and means on said valve body for causing rotation of said ball element in response to upward and downward movement of said mounting means.

6. The apparatus of claim 5 wherein said second hydraulically operable means includes a drive sleeve coupled to said mounting means and movable downwardly in response to pressurization of said control line to force downward movement of said mounting means and rotation of said ball element to open position.

7. The apparatus of claim 6 further including spring means reacting between said valve body and said mounting means for shifting said mounting means upwardly within said valve body to enable automatic closure of said ball element in the absence of pressurization of said control line.

8. The apparatus of claim 7 further including piston means on said drive sleeve responsive to pressurized fluid in an additional control line for exerting upward force on said drive sleeve and said mounting means to assist in closure of said ball element.

9. The apparatus of claim 8 further including means for releasably coupling said drive sleeve to said mounting means, said coupling means including laterally shiftable latch means on said drive sleeve engageable with detent means on an upper end portion of said mounting means, and selectively operable lock means movable between one position preventing disengagement of said latch means from said detent means and another position enabling such disengagement.

10. Apparatus adapted to be positioned in a subsea blowout preventer stack or the like for controlling the flow of fluid from an offshore well, comprising: a valve body having a flow passage; a mounting sleeve movable upwardly and downwardly within said flow passage and with respect to said valve body between upper and lower position; first and second valve assemblies carried by said mounting sleeve, one of said valve assemblies including a ball valve element rotatable between open and closed positions with respect to said flow passage; means on said valve body for rotating said ball element to open position in response to downward movement of said mounting sleeve and for rotating said ball element to closed position in response to upward movement of said mounting sleeve; and means for urging said mounting sleeve toward said upper position where said ball valve element is closed.

11. The apparatus of claim 10 wherein said urging means includes a spring that reacts between said valve body and said mounting sleeve, and further including connector means at the upper end portion of said mounting sleeve arranged and adapted for application of upward force to said mounting sleeve to assist said spring means in causing rotation of said ball element to closed position.

12. The apparatus of claim 11 wherein the other of said valve assemblies includes a flapper valve element pivoted to said mounting sleeve and movable between open and closed positions with respect to said flow passage; and means for continuously biasing said flapper valve element toward closed position.

13. The apparatus of claim 11 wherein said one valve assembly is mounted on said mounting sleeve below said other valve assembly.

14. Apparatus adapted to be landed in a subsea blowout preventer stack or the like for controlling the flow of fluids from an offshore well, comprising: a valve body adapted for connection to a conduit means extending into the well, said valve body having a flow passage; upper and lower valve assemblies in said body for opening and closing said passage, said upper valve assembly having a downwardly facing valve seat surrounding said flow passage and a normally closed flapper valve element adapted for pivotal rotation between an open position to the side of said flow passage below said valve seat and a closed position against said valve seat, said lower valve assembly having a downwardly facing valve seat surrounding said flow passage and a ball valve element that is rotatable between a closed position where a peripheral surface thereof engages said last-mentioned valve seat and an open position where a throughbore therein is aligned with said flow passage; means movable upwardly and downwardly within said flow passage and with respect to said valve body between upper and lower positions therein for mounting said valve assemblies; means on said valve body for rotating said ball element to open position in response to downward movement of said mounting means and for rotating said ball element to closed position in response to upward movement of said mounting means; and means reacting between said valve body and said mounting means for continuously urging said mounting means toward said upper position.

15. Apparatus adapted for operating a subsea control line that controls a flow of fluid from an offshore well, comprising: an elongated housing member having means at its upper end for connecting to a pipe string; laterally shiftable means carried at the lower end of said housing member for latching said housing member to a valve body; and first and second hydraulically operable means within said housing member, said first hydraulically operable means including a first piston assembly having an upwardly facing pressure surface subject to the pressure of a control fluid whereby said piston assembly moves downwardly within said housing member in response to said pressure for opening an associated valve means, said second hydraulically operable means including a second piston assembly having an upwardly facing pressure surface subject also to the pressure of said control fluid and movable downwardly in response thereto for opening an associated valve means.

16. The apparatus of claim 15 wherein said first hydraulically operable means further includes telescoping tubular members having a lost-motion connection, and spring means reacting between said members for urging said members in opposite longitudinal directions.

17. The apparatus of claim 15 wherein said second hydraulically operable means includes a drive sleeve assembly having releasable connector means at its lower end, and further including spring means reacting between said drive sleeve assembly and said first hydraulically operable means for urging said first hydraulically operable means upwardly with respect to said second hydraulically operable means.

18. The apparatus of claim 15 wherein said second hydraulically operable means includes a downwardly facing pressure surface subject to the pressure of a fluid in a second control line and movable upwardly in response thereto for assisting in effecting closure of an associated valve means.

19. The apparatus of claim 15 further including a tubular latch mandrel carried on said housing member and movable between upper and lower positions with respect thereto for respectively enabling release of said latch means from a valve body and locking said latch means in engagement therewith, said latch mandrel having piston means thereon providing a downwardly facing surface subject to the pressure of a control fluid for causing upward movement of said latch mandrel from said lower position to said upper position.

20. The apparatus of claim 19 further including spring means for biasing said latch mandrel toward said lower position for normally locking said latch means in engagement with a valve body.

21. The apparatus of claim 20 further including means threaded to said housing member and splined to said latch mandrel for feeding said latch mandrel from said lower position to said upper position in response to rotation of said housing member relative to said latch mandrel.

* * * * *